US006832874B2

(12) United States Patent
Appleford et al.

(10) Patent No.: US 6,832,874 B2
(45) Date of Patent: Dec. 21, 2004

(54) MODULAR SEABED PROCESSING SYSTEM

(75) Inventors: David Eric Appleford, Essex (GB); Brian William Lane, Essex (GB)

(73) Assignee: Alpha Thames Ltd., Essex (GB)

( * ) Notice: Subject to any disclaimer, the term of this patent is extended or adjusted under 35 U.S.C. 154(b) by 0 days.

(21) Appl. No.: 10/344,956

(22) PCT Filed: Aug. 17, 2001

(86) PCT No.: PCT/GB01/03731

§ 371 (c)(1),
(2), (4) Date: Feb. 18, 2003

(87) PCT Pub. No.: WO02/16734

PCT Pub. Date: Feb. 28, 2002

(65) Prior Publication Data

US 2003/0180096 A1 Sep. 25, 2003

(30) Foreign Application Priority Data

Aug. 18, 2000 (GB) ..... 0020460

(51) Int. Cl.[7] ..... B63C 11/00; E21B 7/12

(52) U.S. Cl. ..... 405/189; 405/188; 405/191; 166/338; 166/340; 166/344; 166/349; 166/351

(58) Field of Search ..... 405/188, 189, 405/190, 191; 166/338, 339, 340, 344, 345, 349, 365, 351

(56) References Cited

U.S. PATENT DOCUMENTS

| | | | | |
|---|---|---|---|---|
| 3,716,100 A | * | 2/1973 | Nelson | 166/344 |
| 4,194,857 A | | 3/1980 | Chateau et al. | |
| 4,427,072 A | | 1/1984 | Lawson | |
| 4,615,646 A | * | 10/1986 | Langner | 405/169 |
| 4,832,124 A | * | 5/1989 | Rayson | 166/339 |
| 5,040,607 A | | 8/1991 | Cordeiro et al. | |
| 5,593,249 A | * | 1/1997 | Cox et al. | 405/191 |
| 6,068,427 A | * | 5/2000 | .O slashed.stergaard | 405/191 |
| 6,223,675 B1 | * | 5/2001 | Watt et al. | 405/190 |
| 6,227,301 B1 | * | 5/2001 | Edwards et al. | 166/344 |

FOREIGN PATENT DOCUMENTS

| | | |
|---|---|---|
| GB | 2 202 256 A | 9/1988 |
| GB | 2 202 561 A | 9/1988 |
| GB | 2 261 271 A | 5/1993 |
| WO | WO00/47864 A1 | 8/2000 |

* cited by examiner

*Primary Examiner*—Jong-Suk Lee
(74) *Attorney, Agent, or Firm*—Summa & Allan, P.A.

(57) ABSTRACT

To install a modular seabed processing system (1) on a seabed, a monopile foundation (3) is first lowered down and driven into the seabed. A docking unit (4) is lowered towards the installed foundation (3) so that a mating clamp system (6) mounted on the docking unit is aligned with a spigot (5) on the foundation. The clamp system then clamps the spigot to fix the docking unit onto the foundation. Flowlines (2) and an electrical power connector plug (18) are connected to the docking unit. A first retrievable substantially autonomous module (8) is lowered and connected to the docking unit (4) by a multi-bored connector (10, 11) and the plug (18) on the docking unit is engaged by a corresponding socket (17) on the module. Isolation valves (14, 16) in the docking unit and module are opened so that the module (8) is able to act on fluid received from the flowlines (2) via the multi-bored connector (10, 11). A second retrievable substantially autonomous module is also connected to the docking unit (4) in the same way.

28 Claims, 12 Drawing Sheets

MODULAR SEABED PROCESSING SYSTEM

FIELD OF THE INVENTION

The present invention relates to a system suitable for exploiting oil/gas fields and, more particularly, subsea fields and a method of installing such a system.

BACKGROUND OF THE INVENTION

Conventional oil/gas fields have a plurality of wells linked to a host facility which receives the oil/gas via flow lines. A conventional underwater oil/gas field may include modularised processing systems between the wells and the host facility.

GB 2261271 describes a modularised processing system which is used to separate a mixture of oil, gas and water from wells into its individual components. The system comprises an offshore installation in which interchangeable modules are individually supported in a support framework located on the seabed, the modules being used to separate the mixture. Two-part connectors enable modules to be lowered from the surface of the sea into the framework and be connected up to the wells. The modules can also be retrieved from the system so that maintenance can be carried out on them when they are out of the water.

Such a framework is a large, heavy structure which requires expensive guidance means for guiding the modules into the framework.

SUMMARY OF THE INVENTION

It is therefore an object of the present invention to provide an improved system for such modules and a method of installation of such a system.

According to one aspect of the present invention there is provided a method of installing a system, comprising the steps of:

installing a foundation into ground;

fixing a docking unit to the foundation via a single connection;

connecting flowlines to the docking unit; and connecting at least one retrievable substantially autonomous module to the docking unit so that the or each module is able to act on fluid received from the flowlines.

By having a single connection between the docking unit and the foundation, the installation of the docking unit is made far simpler. The single connection may comprise a connection of a type used for a well head.

The step of fixing the docking unit to the foundation via a single connection may comprise clamping a mating clamp arrangement attached to one of the docking unit or the foundation to a protrusion attached to the other of the docking unit or foundation. The protrusion is preferably substantially centrally placed on the docking unit or foundation.

The step of connecting at least one retrievable substantially autonomous module to the docking unit desirably includes actuating isolation means to connect at least one module to the flowlines, the isolation means comprising a first portion in the module and a complementary second portion in the docking unit.

The method may include an uninstalling step of disconnecting one said retrievable substantially autonomous module from the docking unit, without affecting the operation of any other retrievable substantially autonomous module with the flowlines and without effecting the connection of any other such module. The uninstalling step desirably includes actuating the isolation means to isolate the module being disconnected from the docking unit and the flowlines connected thereto.

The isolation means may comprise an isolation connector of a type used for a well head. The isolation means may comprise a multi-ported valve isolation connector.

It may be desirable for the method to include the steps of connecting a first portion of a power connector to the docking unit, the first portion of the power connector being connected to a power source remote from the docking unit, and connecting a complementary second portion of the power connector in one said retrievable substantially autonomous module to the first portion so that the power source is able to provide power to the module. The power connector may be adapted to carry control signals to or from the module.

The step of connecting at least one retrievable substantially autonomous module to the docking unit may include providing guiding means to guide said module into connection with the docking unit. The guiding means desirably ensures that the second portion of the power connector of the module engages the first portion of the power connector on the docking unit.

The ground is preferably a seabed. The foundation may comprise a single pile.

According to another aspect of the present invention there is provided a system comprising:

a foundation installed into ground;

a docking unit fixed to the foundation via a single connection; and at least one retrievable substantially autonomous module, the or each module being connected to the docking unit so that the or each module is able to act on fluid received from the flowlines.

The system has a much smaller "footprint" on, say, a seabed, and is also lighter and cheaper than a system having a support framework for interchangeable modules.

BRIEF DESCRIPTION OF THE DRAWINGS

Embodiments of the present invention will now be described, by way of example, with reference to the accompanying drawings, in which:—

DESCRIPTION OF THE PREFERRED EMBODIMENTS

Figure 2:
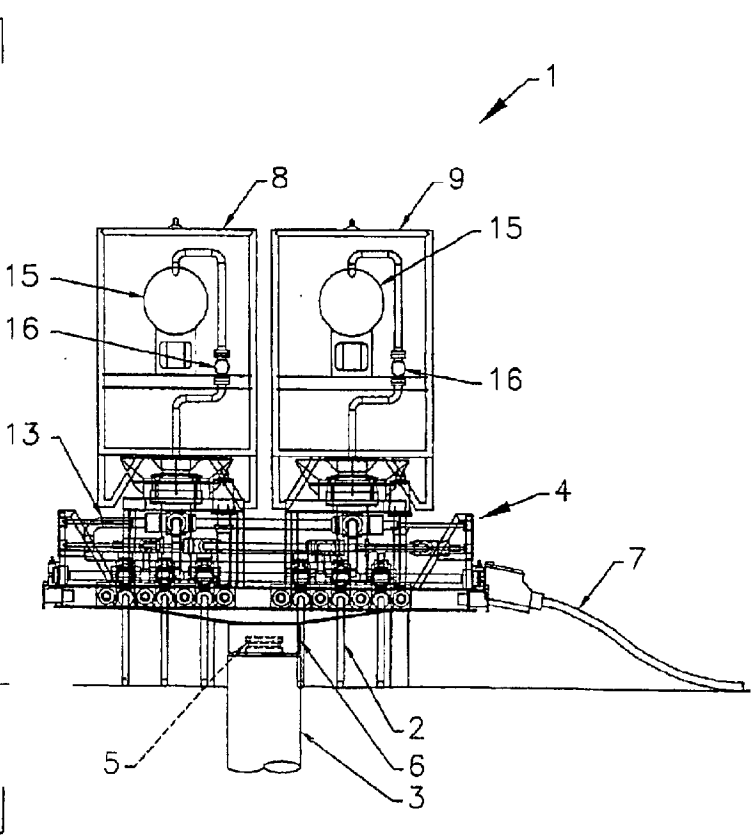
FIGS. 1 and 2 are side elevations of a system, according to one embodiment of the invention.
Figure 1:
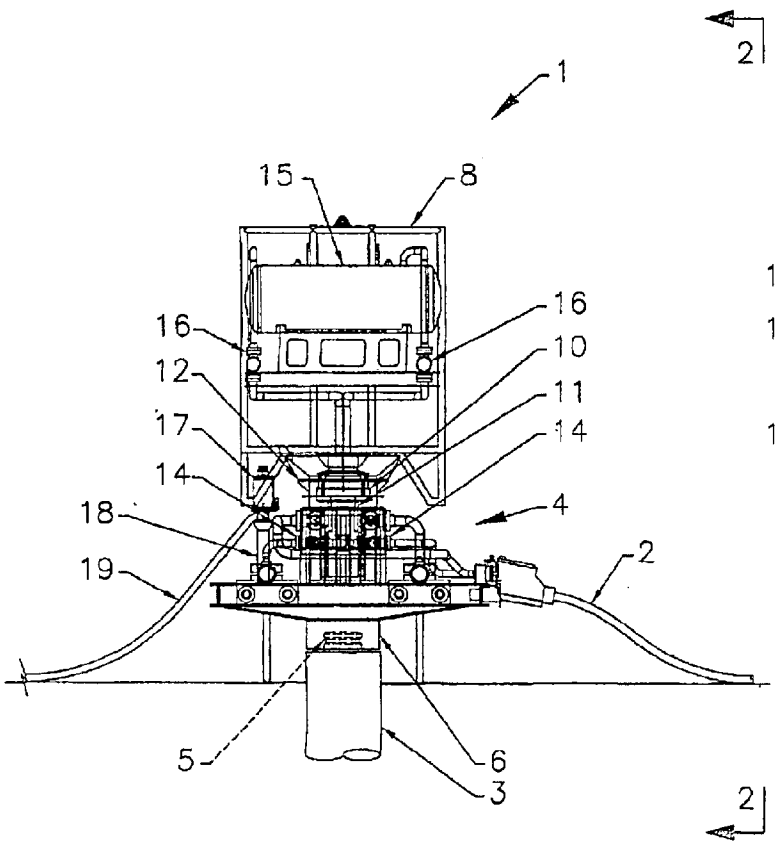

Referring to FIGS. 1 and 2 of the accompanying drawings, a modular seabed processing system 1 is illustrated which is connected by underwater flowlines 2 to wells (not shown) which remove a fluid mixture comprising water and oil/gas from reservoirs beneath the seabed. The system comprises a monopile foundation 3 to which a docking unit or manifold 4 is connected. A spigot 5 (see FIG. 3) projects upwardly from the centre of the head of the pile 3 and is clamped by a mating clamp system 6 mounted to the base of the docking unit 4. The spigot 5 is an integral part of the pile 3.

The flowlines 2 from the wells are connected to the docking unit 4 and pipelines or flowlines 7 connect the docking unit 4 to a host facility (not shown). The host facility may be, for example, onshore or on a fixed or a floating rig.

Also connected to the docking unit 4 is a pair of retrievable substantially autonomous modules 8,9. Each module 8,9 has a first portion 10 of a multi-bored connector (see also FIGS. 12 and 13) at its base which is connected to a complementary second portion 11 of the multi-bored connector (see also FIGS. 6 and 7) mounted on top of the docking unit 4, each multi-bored connector has a guidance cone 12 surrounding it for alignment purposes when a module is installed on the docking unit. Pipework 13 is provided within the docking unit 4 to connect the flowlines 2 and the pipelines 7 to the second portion 11 of the multi-bored connector. The pipework has isolation valves 14.

Each retrievable substantially autonomous module 8,9 has a separator chamber 15 for separating fluids from the fluid mixture. The separator chamber 15 is connected to the first portion 10 of the multi-bored connector via isolation valves 16.

Each module 8,9 has an electric power connector socket 17 engaged with a corresponding plug 18 attached to the docking unit 4. Each plug 18 is connected to an integrated umbilical 19 from the host facility. The umbilicals 19 are adapted to provide power, control signals and chemical injection from the host facility to the modules 8,9. The control signals are sent to control, reprogramme or shut down the modules 8,9 which are otherwise self-controlling during normal running. The chemicals are injected into the modules 8,9 as part of their normal operation or as a result of a planned or unplanned shut down to prevent unwanted chemical reactions such as hydrate formation, wax deposition and corrosion. Each module 8,9 also has stab connectors (not shown) for connecting to corresponding stab connectors (not shown) on the docking unit 4 so that the module is able to receive the chemical injection.

Referring to FIGS. 3 to 17, the process of installation of the system on a seabed will now be described.

Figure 3:
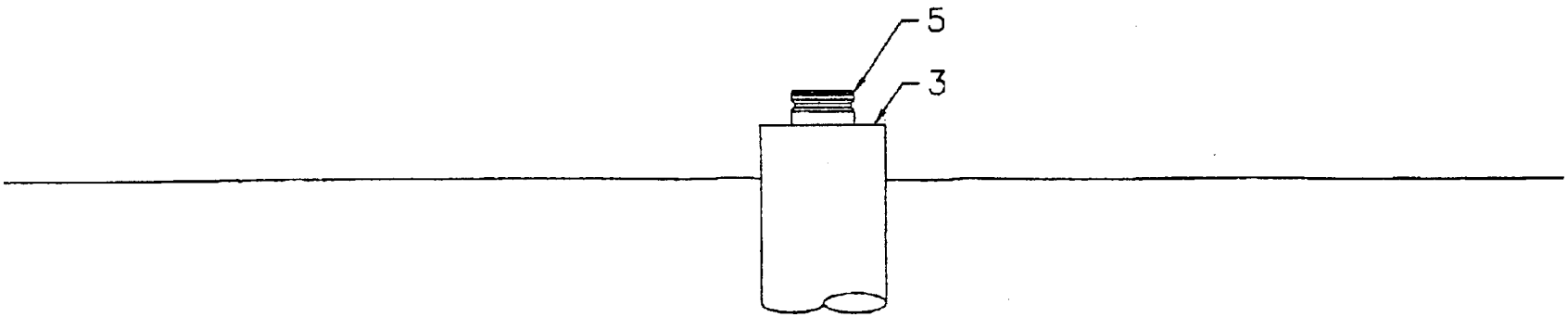
FIGS. 3 to 17 are side elevations showing the installation of the system.

The monopile foundation 3 is lowered down to the seabed and driven into the seabed in a conventional manner. FIG. 3 shows it installed.

The isolation valves 14 in the pipework 13 in the docking unit 4 are set to closed positions.

Figure 5:
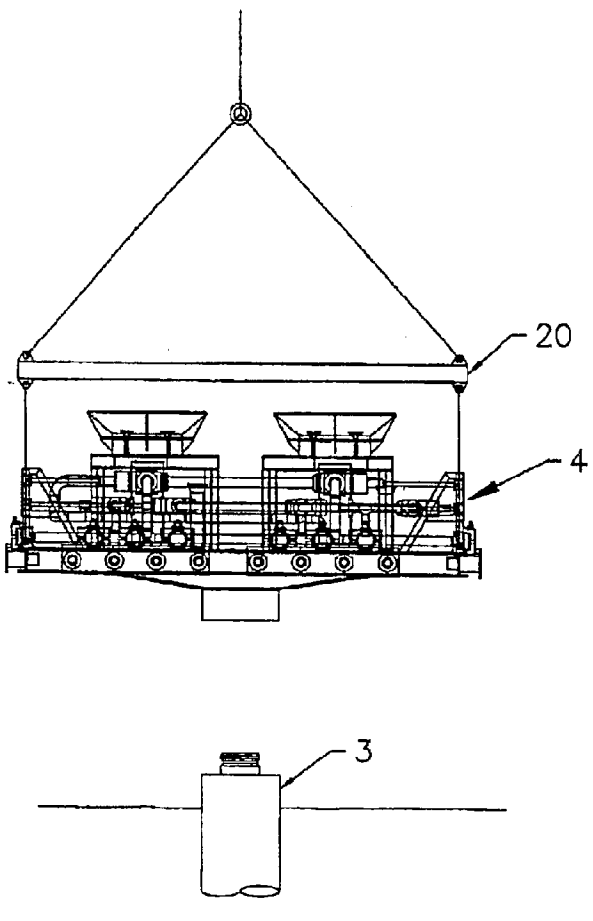
Figure 4:
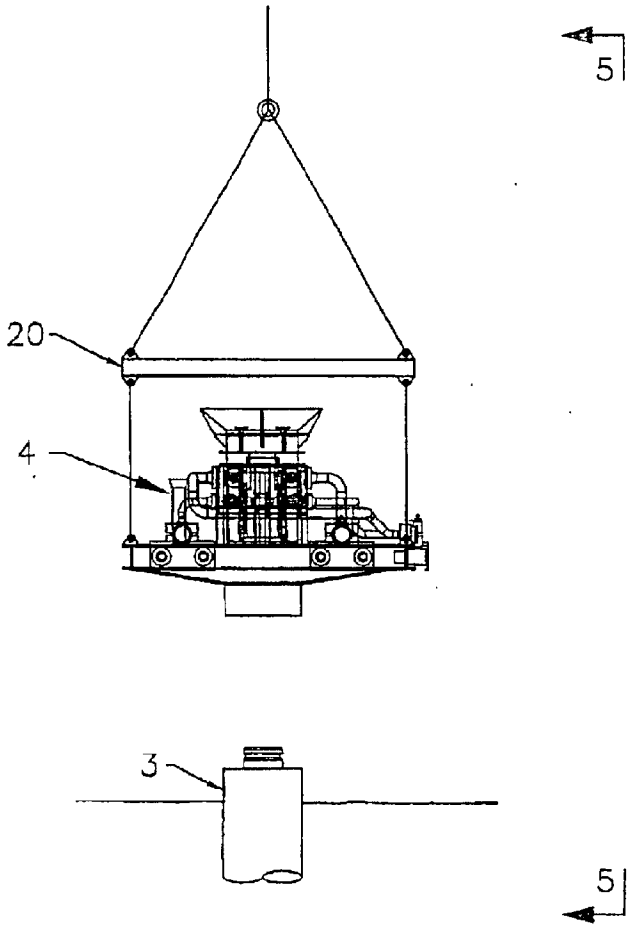

[FIGS. 4 and 5] The docking unit 4 is placed in installation rigging 20 which is lowered from a surface vessel towards the monopile foundation 3.

Figure 7:
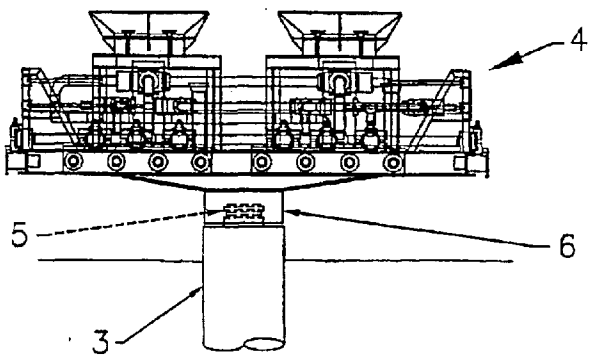
Figure 6:
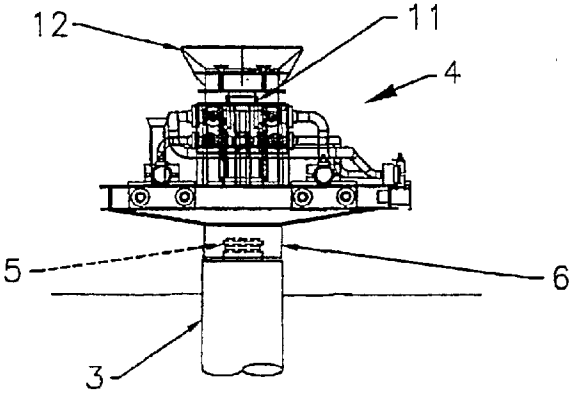

[FIGS. 6 and 7] The mating clamp system 6 mounted on the base of the docking unit is approximately aligned with the spigot 5, the mating clamp system being then remotely activated by, say, a remotely operated vehicle (ROV), so as to clamp the spigot, fixing the docking unit 4 to the monopile foundation 3.

Figure 9:
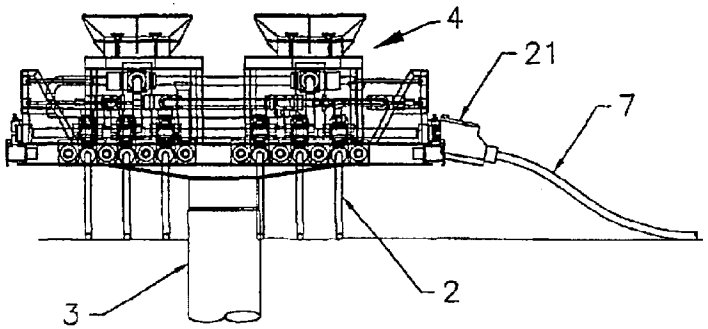
Figure 8:
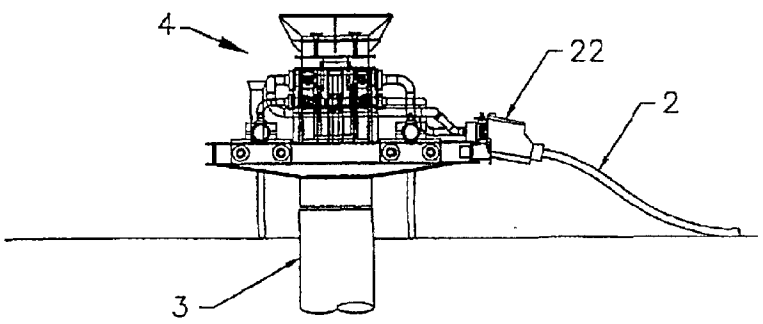

[FIGS. 8 and 9] Pipeline connectors 21 at the end of the pipelines 7 from the host facility are connected to the docking unit 4 and flowline connectors 22 at the end of flowlines 2 from the wellheads are connected to the docking unit in a conventional manner by, say, ROVs or remotely operated tools (ROTs).

Figure 11:
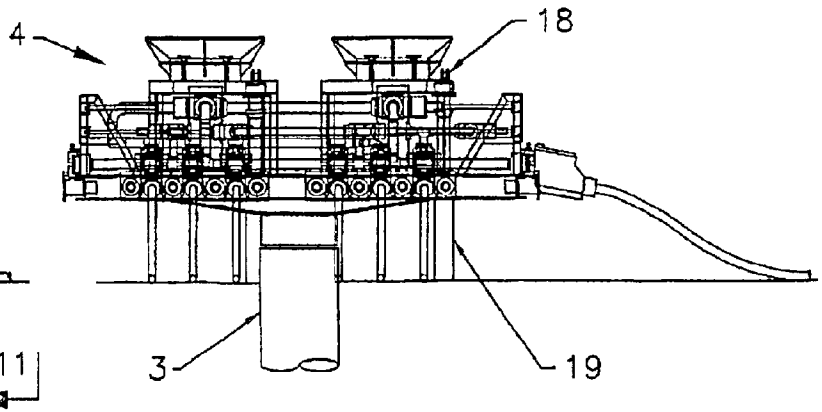
Figure 10:
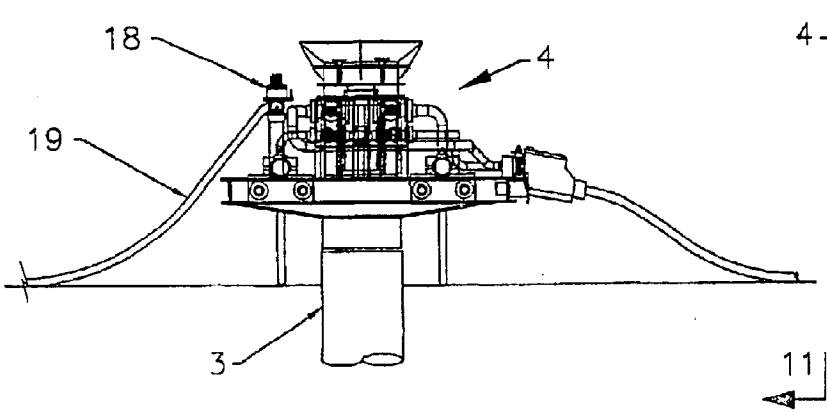

[FIGS. 10 and 11] The electrical power connector plug 18 at the end of the umbilical 19 from the host facility is attached to the docking unit 4 in a conventional manner by being lowered from the surface vessel.

Before a first retrievable substantially autonomous module 8 is lowered from, for example, the surface vessel towards the docking unit 4, the module isolation valves 16 are set to closed positions. Systems in the module 8 are rigorously tested before the module is lowered.

Figure 13:
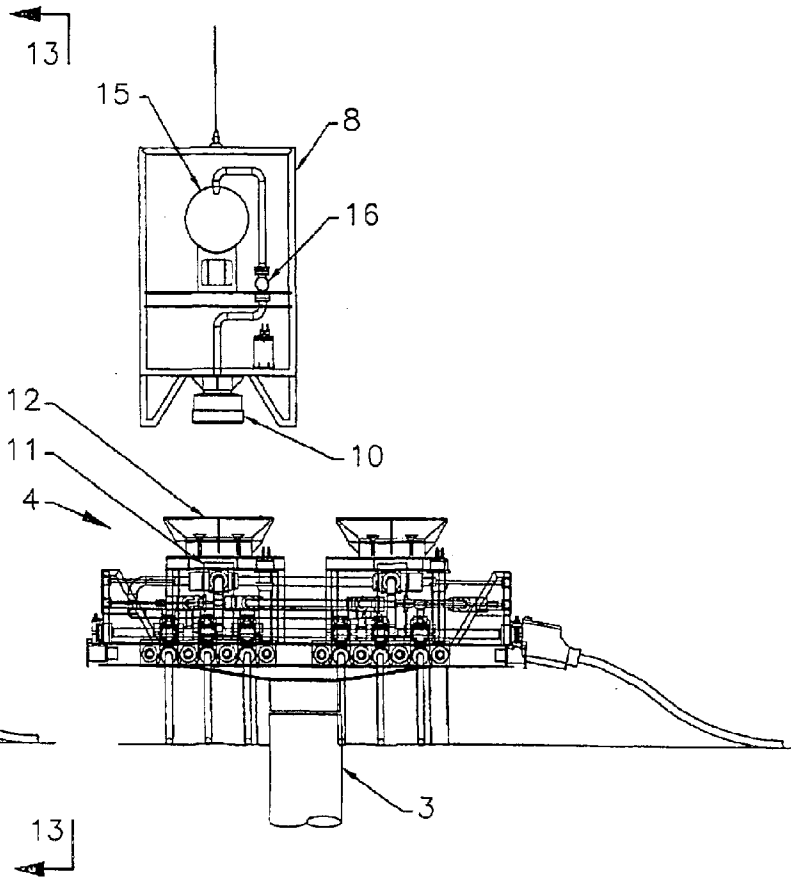
Figure 12:
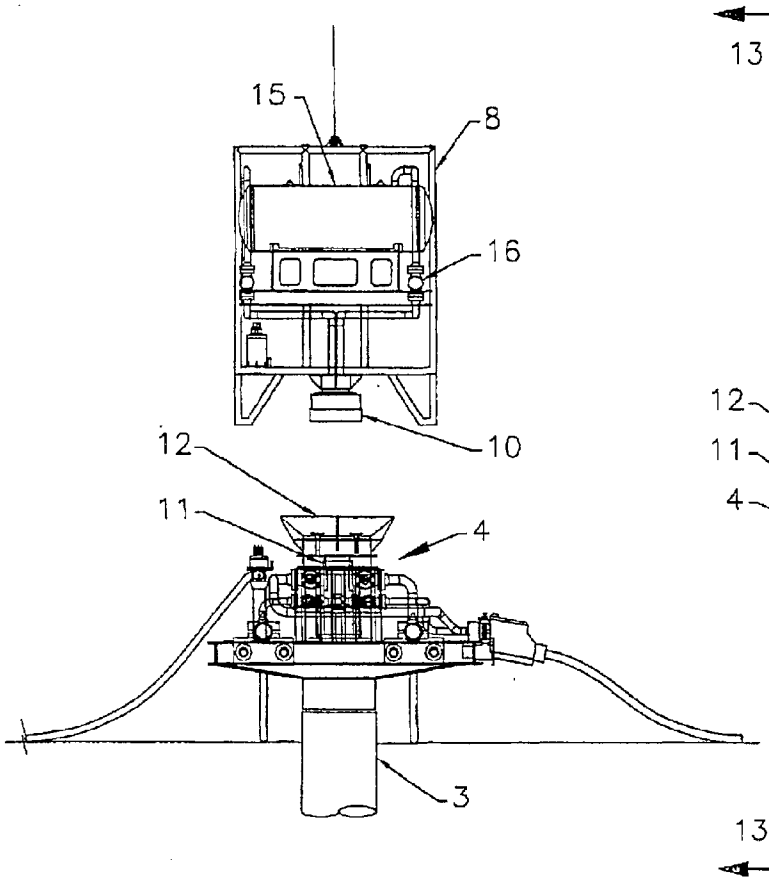

[FIGS. 12 and 13] The first retrievable substantially autonomous module 8 is then lowered towards the docking unit 4.

The first portion 10 of the multi-bored connector at the base of the module 8 is approximately aligned with one of the guidance cones 12 on the docking unit 4. The cone 12 guides the first portion 10 into specific alignment with the complementary second portion 11 of the multi-bored connector.

Figure 15:
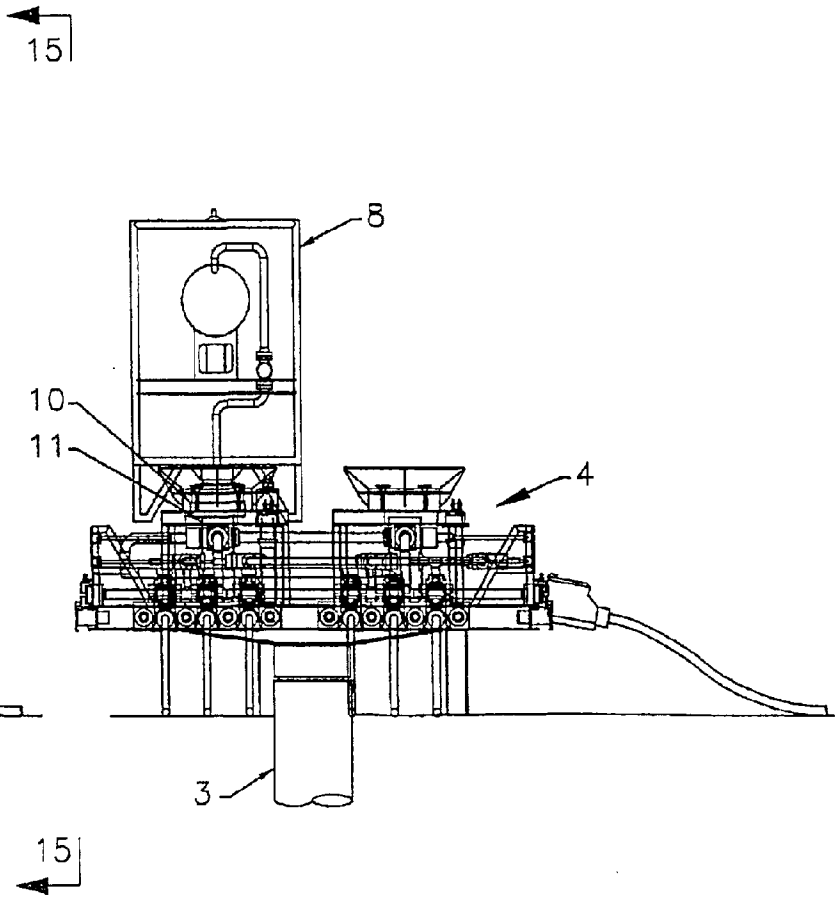
Figure 14:
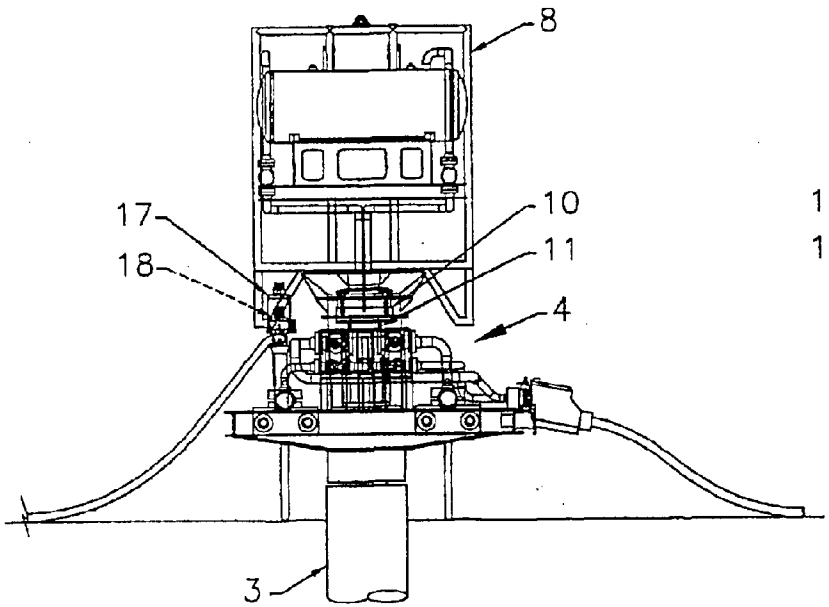

[FIGS. 14 and 15] When the first and second portions 10,11 of the multi-bored connector 11 are correctly aligned, this causes the electrical power connector socket 17 of the module 8 to be specifically aligned with a corresponding electrical power connector plug 18 on the docking unit 4. Thus, the two portions 10,11 of the multi-bored connector engage and the plug 18 and socket 17 engage.

Figure 17:
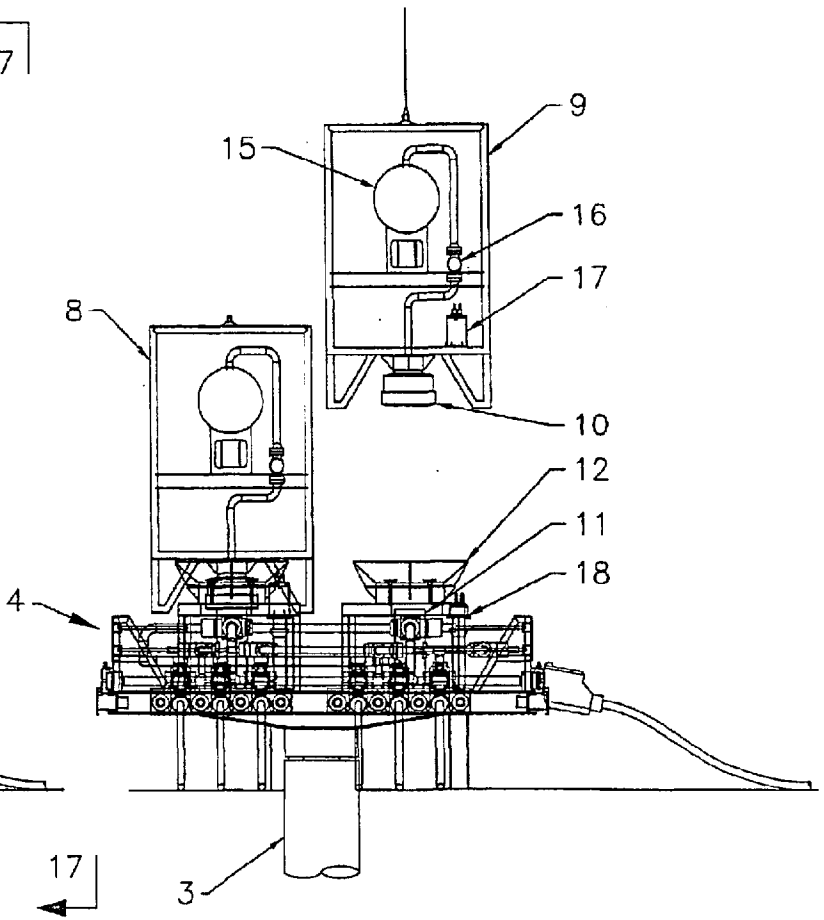
Figure 16:
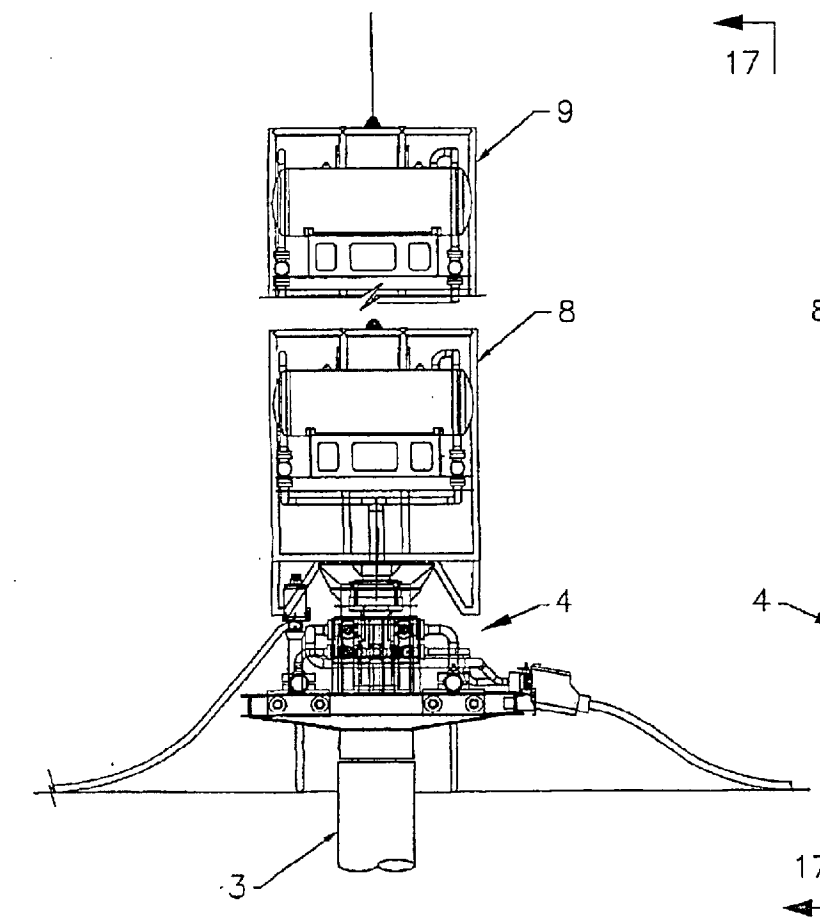

[FIGS. 16 and 17] A second retrievable autonomous module 9 is lowered and installed on the docking unit 4 in the same way.

Referring back to FIGS. 1 and 2, in use, the docking unit isolation valves 14 and the module isolation valves 16 are opened. Fluid mixture from the wells is received into the module separator chambers 15 via the flowlines 2 and the open isolation valves 14,16. The fluid mixture is separated into gas and liquid by the module separator chambers 15. The separated gas and liquid are then transported by the pipelines 7 to the host facility.

To retrieve one of the modules from the seabed processing system 1, that module 8 needs to be uninstalled. The module 8 to be disconnected is isolated from the rest of the seabed processing system 1 by closing the isolation valves 14 in the pipework 13 to the second portion of the multi-bored connector 11 for that module 8 and the isolation valves 16 in that module. The module 8 is then retrieved without affecting the connection of the other module 9 in the system. Hence, the production operation of the other module 9 is not disturbed. Thus, a module may be easily retrieved for maintenance/repair purposes.

A module may be retrieved so that it can be reconfigured for another use. A module may not have a separator chamber but may, for example, be configured to simply manifold or pump fluid mixture received from the connected wells.

Figure 19:
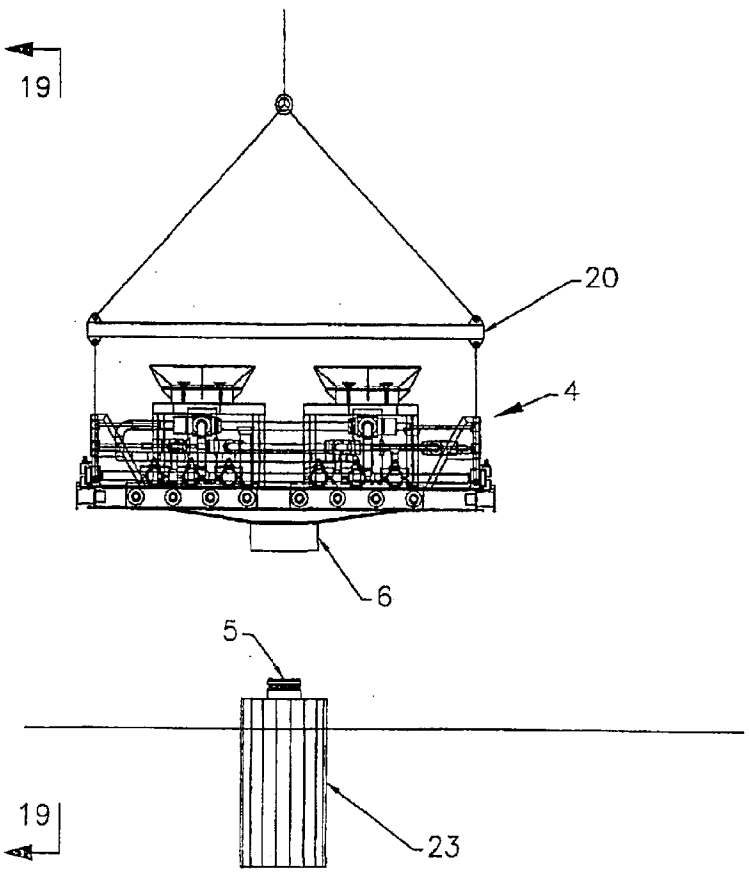
FIGS. 18 to 23 are side elevations showing modifications to the foundations for the system.
Figure 18:
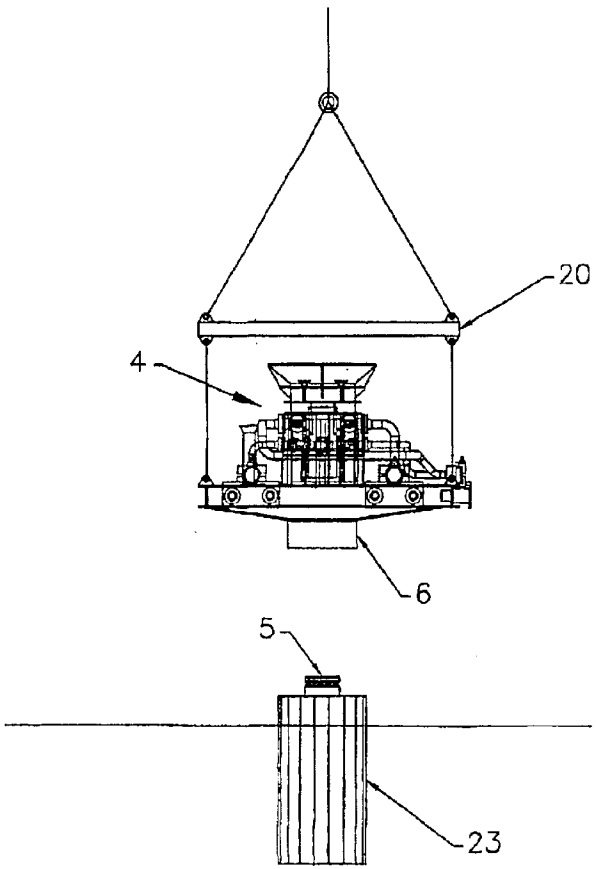

In a modification shown in FIGS. 18 and 19, the monopile foundation has been replaced by a caisson pile base foundation which also has a centrally placed spigot 5, projecting upwardly from the head of the foundation, for being clamped by the mating clamp system 6 at the base of the docking unit 4 when it is lowered onto it by an installation frame 20.

Figures 20, 21:
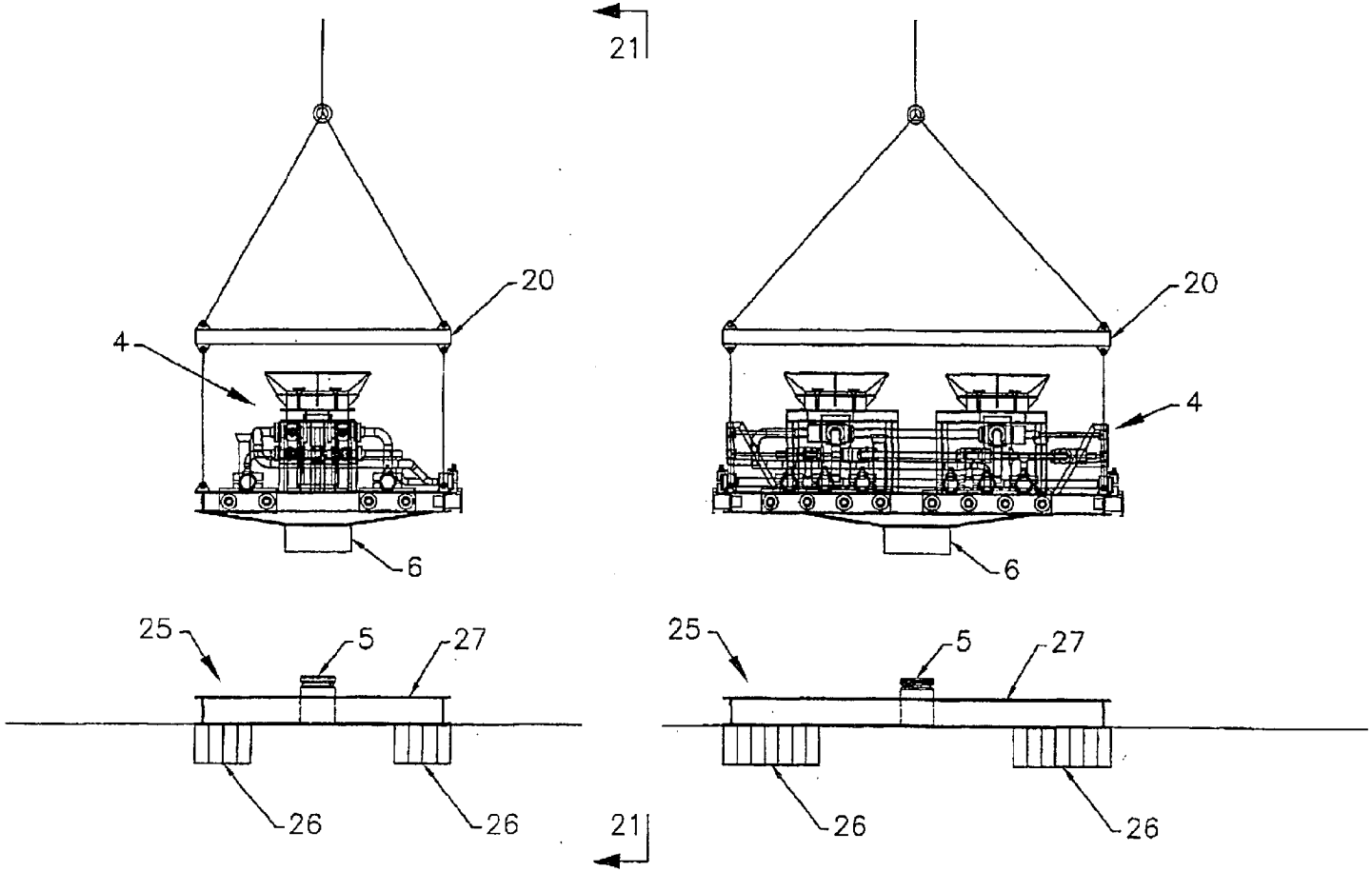

In another modification shown in FIGS. 20 and 21, the monopile foundation has been replaced by a suction base foundation 25. This comprises a number of compartments 26 attached to the underside of a framework 27, wherein water is pumped out of the compartments to draw them into the seabed. The framework 27 has a centrally placed spigot 5 projecting upwardly therefrom. This spigot 5 is also adapted to being clamped by the mating clamp system 6 at the base of the docking unit 4 when it is lowered onto it by an installation frame 20.

Figure 23:
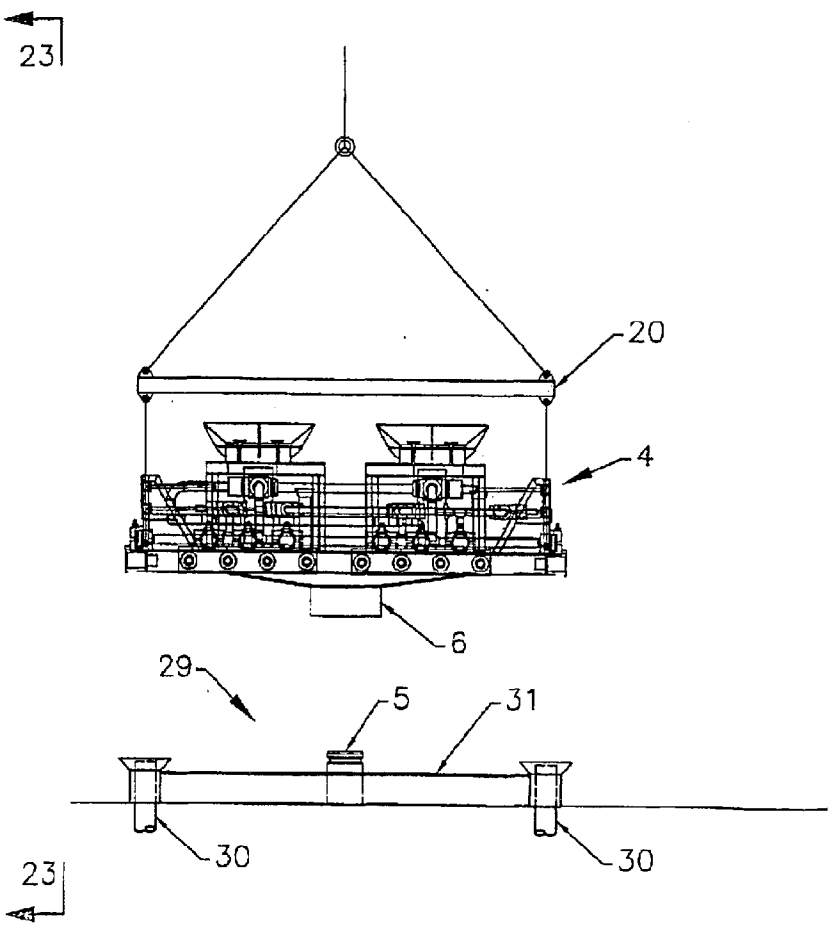
Figure 22:
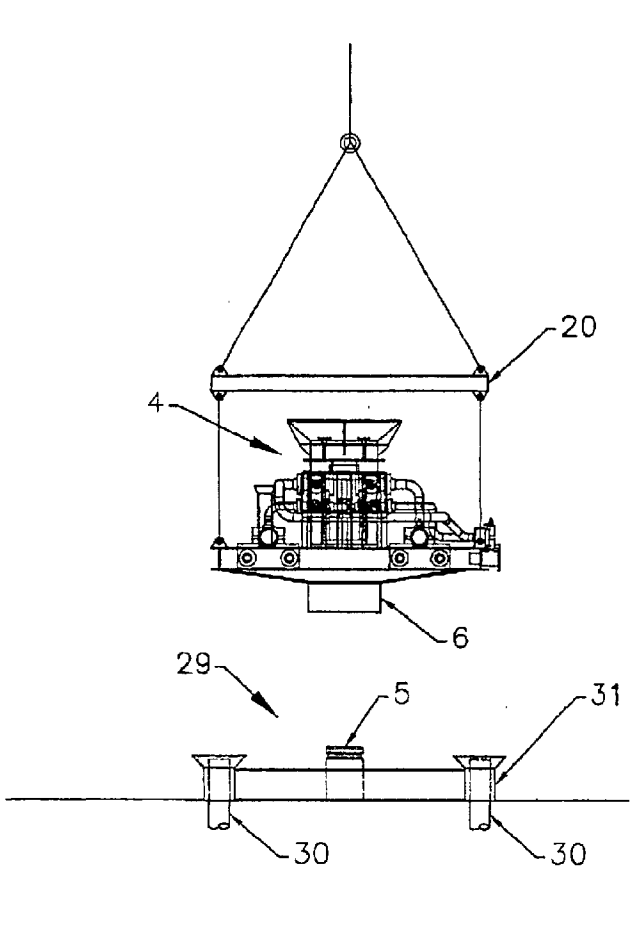

In yet another modification shown in FIGS. 22 and 23, the monopile foundation has been replaced by a mechanically locked pile foundation 29. This comprises a number of piles 30 installed in the seabed with a framework 31 surrounding the top portion of the piles. The piles 30 are then mechanically locked to the framework 31, such as by expanding the outer tube of each pile 30 so that it forcefully engages the surrounding framework 31. The framework 31 has a centrally placed spigot 5 projecting upwardly therefrom which is adapted to be clamped by the mating clamp 6 system at the base of the docking unit 4 when it is lowered onto it by an installation frame 20.

A system according to the invention is capable of operating at large "step-out" distances such as over 50 Km from a host facility and in deep water. Therefore, less host facilities are required to exploit a particular field and the life of a host facility can be extended by connecting it to remote satellite fields. Furthermore the system permits abandoned fields to be reopened and marginal fields to be exploited.

The system may use connecting means used for a well head for connecting the docking unit 4 to the foundation 3. The multi-bored connector 10, 11 may comprise other connecting means used for a well head. The multibored connector may be a multi-bored valve isolation connector, such as the one described in GB 2261271.

Whilst a particular embodiment has been described, it will be understood that various modifications may be made without departing from the scope of the invention. For example, any suitable number of seabed processing systems may be used in a field.

The docking unit may be designed to hold any suitable number of retrievable substantially autonomous modules.

The pipelines between the seabed processing systems and the host facility may carry any suitable component separated from the fluid mixture extracted by wells.

The integrated umbilical may be replaced with separate power, control signal and chemical injection lines. Separate power and control signal lines may be replaced by an integrated power/control line.

The system may be land-based and not underwater.

What is claimed is:

1. A method of installing a modular processing system comprising the steps of:

installing a foundation into ground;

fixing a docking unit to the foundation via a single connection;

connecting at least one flowline to the docking unit; and connecting at least one retrievable substantially autonomous module to the docking unit so that the module is able to act on fluid received from the flowline by actuating isolation means to connect at least one module to said at least one flowline, the isolation means comprising a first portion in the module and a complementary second portion in the docking unit.

2. A method as claimed in claim 1, wherein the step of fixing the docking unit to the foundation via a single connection comprises clamping a mating clamp arrangement attached to one of the docking unit or the foundation to a protrusion attached to the other of the docking unit or foundation.

3. A method as claimed in claim 2, wherein the protrusion is substantially centrally placed on the docking unit or foundation.

4. A method as claimed in claim 1, including an uninstalling step of disconnecting one said retrievable substantially autonomous module from the docking unit without affecting the operation of any other retrievable substantially autonomous module and without affecting the connection of any other such module with said at least one flowline.

5. A method as claimed in claim 4, wherein the uninstalling step includes actuating the isolation means to isolate the module being disconnected from the docking unit and said at least one flowline connected thereto.

6. A method as claimed in claim 1, including the steps of connecting a first portion of a power connector to the docking unit, the first portion of the power connector being connected to a power source remote from the docking unit, and connecting a complementary second portion of the power connector comprising part of one said retrievable substantially autonomous module to the first portion so that the power source is able to provide power to the module.

7. A method as claimed in claim 6, wherein the power connector is adapted to carry control signals to or from the module.

8. A method as claimed in claim 6, wherein the step of connecting at least one retrievable substantially autonomous module to the docking unit includes providing guiding means to guide said at least one module into connection with the docking unit.

9. A method as claimed in claim 8, wherein the guiding means ensures that the second portion of the power connector engages the first portion of the power connector.

10. A method as claimed in claim 1, wherein the step of connecting at least one retrievable substantially autonomous module to the docking unit includes providing guiding means to guide said at least one module into connection with the docking unit.

11. A method as claimed in claim 1, including the step of connecting at least one outlet flowline to the docking unit for receiving fluid acted upon by said at least one module.

12. A method as claimed in claim 1, wherein the single connection comprises a connection of a type used for a well head.

13. A method as claimed in claim 1, wherein the isolation means comprises an isolation connector of a type used for a well head.

14. A method as claimed in claim 1, wherein the isolation means comprises a multi-ported valve isolation connector.

15. A method as claimed in claim 1, wherein the foundation comprises a single pile.

16. A method as claimed in claim 1, wherein the ground is a seabed.

17. A modular processing system comprising a foundation installed into ground;

a docking unit fixed to said foundation via a single connection; and at least one retrievable substantially autonomous module, said module being connected to said docking unit so that said module is able to act on fluid received from at least one flowline when said at least one flowline is connected to said docking unit; and isolation means comprising a first portion in one said module and a complementary second portion in said docking unit, said isolation means adapted to be actuated to connect one said module to said at least one flowline.

18. A system as claimed in claim 17, wherein said single connection comprises a mating clamp arrangement attached to one of said docking unit or said foundation clamped to a protrusion attached to the other of said docking unit or said foundation.

19. A system as claimed in claim 18, wherein said protrusion is substantially centrally placed on the docking unit or foundation.

20. A system as claimed in claim 17, including a power connector comprising interconnectable first and second portions, said first portion being connected to said docking unit, and said second portion comprising part of one said retrievable substantially autonomous module.

21. A system as claimed in claim 20, wherein said power connector is adapted to carry control signals to or from said module.

22. A system as claimed in claim 20, including guiding means for guiding said at least one module into connection with said docking unit.

23. A system as claimed in claim 22, wherein said guiding means is adopted to enable said first and second portions of said power connector to engage.

24. A system as claimed in claim 17, including guiding means for guiding said at least one module into connection with said docking unit.

25. A system as claimed in claim 17, wherein said single connection comprises a connection of a type used for a well head.

26. A system as claimed in claim 17, wherein said isolation means comprises an isolation connector of a type used for a well bead.

27. A system as claimed in claim 17, wherein said isolation means comprises a multi-ported valve isolation connector.

28. A system as claimed in claim 17, wherein said foundation comprises a single pile.

* * * * *

UNITED STATES PATENT AND TRADEMARK OFFICE

CERTIFICATE OF CORRECTION

PATENT NO. : 6,832,874 B2
DATED : December 21, 2004
INVENTOR(S) : Appleford et al.

It is certified that error appears in the above-identified patent and that said Letters Patent is hereby corrected as shown below:

Column 7,
Line 11, "adopted" should read -- adapted --.

Signed and Sealed this

Seventh Day of June, 2005

JON W. DUDAS
*Director of the United States Patent and Trademark Office*